US006851512B2

(12) United States Patent
Fox et al.

(10) Patent No.: US 6,851,512 B2
(45) Date of Patent: Feb. 8, 2005

(54) MODULAR MICROPHONE ARRAY FOR SURROUND SOUND RECORDING

(76) Inventors: Charles Whitman Fox, 1947B Robinson Street, Regina, Saskatchewan (CA), S4T 1P4; Wade Casey McGregor, 2886 Mount Seymour Parkway, North Vancouver, British Columbia (CA), V2H 1E9

( * ) Notice: Subject to any disclaimer, the term of this patent is extended or adjusted under 35 U.S.C. 154(b) by 0 days.

(21) Appl. No.: 10/377,399

(22) Filed: Mar. 3, 2003

(65) Prior Publication Data

US 2003/0209383 A1 Nov. 13, 2003

(30) Foreign Application Priority Data

Mar. 1, 2002 (CA) ..... 2374299

(51) Int. Cl.[7] ..... G10K 13/00; H04R 7/00; H04R 5/02; H04R 1/02; H04R 3/12

(52) U.S. Cl. ..... 181/158; 381/26; 381/91; 381/122; 381/92

(58) Field of Search ..... 181/158, 242, 181/153, 171, 199, 148; 381/26, 91, 122, 92, 66, 94.1, 94.7, 355, 356, 361–363, 366

(56) References Cited

U.S. PATENT DOCUMENTS

| | | | | | |
|---|---|---|---|---|---|
| 3,095,484 | A | * | 6/1963 | Beaverson et al. | 181/158 |
| 3,573,400 | A | * | 4/1971 | Sessler et al. | 381/357 |
| 4,042,779 | A | | 8/1977 | Craven et al. | 179/1 DM |
| 4,179,008 | A | * | 12/1979 | LeTourneau | 181/147 |
| 4,311,874 | A | * | 1/1982 | Wallace, Jr. | 381/92 |
| 4,361,736 | A | | 11/1982 | Long et al. | 179/121 R |
| 4,393,270 | A | * | 7/1983 | van den Berg | 381/356 |
| 4,466,117 | A | * | 8/1984 | Gorike | 381/26 |
| 4,536,887 | A | * | 8/1985 | Kaneda et al. | 381/92 |
| 4,658,932 | A | | 4/1987 | Billingsley | 181/175 |
| 4,673,057 | A | * | 6/1987 | Glassco | 181/153 |
| 4,675,906 | A | | 6/1987 | Sessler et al. | 381/92 |
| 4,888,807 | A | * | 12/1989 | Reichel | 381/92 |
| 5,778,083 | A | | 7/1998 | Godfrey | 381/92 |
| 6,041,127 | A | | 3/2000 | Elko | 381/92 |
| 6,507,659 | B1 | * | 1/2003 | Iredale et al. | 381/26 |
| RE38,350 | E | * | 12/2003 | Godfrey | 381/92 |

FOREIGN PATENT DOCUMENTS

| | | | | |
|---|---|---|---|---|
| EP | 0 848 572 A1 | | 6/1998 | |
| JP | 02288455 A | * | 11/1990 | H04M/9/00 |
| JP | 10285688 A | * | 10/1998 | H04R/5/027 |

OTHER PUBLICATIONS

Michael Williams and Guillaume Le Du, "Multichannel sound recording, Multichannel Microphone Array Design (MMAD)", 2002 Rycote Microphone Windshields Ltd.and Human Computer Interface.*

Michael Williams and Guillaume Le Du, "The Quick Reference Guide to Multichannel Microphone Arrays, Part 1: using Cardioi Microphones", May 12–15 2001, Presented at the Audio Engineering Society 110th Convention, Convention Paper 5336.*

* cited by examiner

*Primary Examiner*—Edgardo San Martin
(74) *Attorney, Agent, or Firm*—Adrian D. Battison; Michael R. Williams; Ryan W. Dupuis

(57) ABSTRACT

A modular multiple microphone array method and mounting system that facilitates surround sound multichannel recording. Array configuration allows accurate and repeatable configurations suited to studio and field use. The lightweight design ensures portability and ease of placement in a variety of field recording situations: musical performance recording, film and video production, broadcast, sound effects recording, soundscape recording, etc. Versatility built into the array design allows compatibility with a variety of sound recording standards, from single channel mono to multichannel stereo and surround sound.

23 Claims, 3 Drawing Sheets

MODULAR MICROPHONE ARRAY FOR SURROUND SOUND RECORDING

This invention relates to a microphone mounting system which is primarily but not exclusively designed for use in recording surround (multichannel) sound but can be used for monaural (single channel) or stereo (two channel) sound recording.

BACKGROUND OF THE INVENTION

In U.S. Pat. No. 5,778,083 issued 7 Jul. 1998 to Godfrey is disclosed a surround sound microphone known under the trade mark "Holophone". This was first marketed in 1999 and company literature states that the Holophone "covers virtually all forms of microphone technology for recording in surround sound, including the number of channels or kind of pick-ups for a wide variety of applications". The Holophone is extremely expensive and complex as a design for recording surround sound, the device is not currently being sold. The patent discloses a microphone system includes a portable frame for mounting linear pick-up microphones such that each of the microphones has its diaphragm facing outwards from the frame and the diaphragms form a generally elliptical pattern. A microphone with a substantially hemispherical pick-up pattern is mounted on the frame such that it is directed upwards and a second substantially hemispherical pick-up pattern microphone is mounted on the frame directed downwards. The linear pick-up pattern microphones are equi-spaced about the perimeter of the frame. There is a hand or camera grip depending downwards from the frame. The microphones of the frame can be electronically connected to the respective channels of a multi-channel sound system, or to the channels of a digital mixer which in turn can be connected to a multi-channel sound recording device. The microphones may be selectively electronically connected to adapt the system for a predetermined sound playback configuration.

The patent claims that in all cases the object must be an elliptical, non-circular pattern or "shape" critical to the microphone placement; the preferred embodiment of the mounting frame or object itself is described as "generally football-shaped".

The patent does not describe the shape of the associated ellipse (the frame) upon which the microphones are mounted as being integral to effecting the reception of sound by the object.

Further, the patent specifies that the lateral microphones must be spaced equidistant from one another, with a control of the pick-up pattern (number of channels and/or type of surround recording) switched electronically, remote from the device. The patent specifies hypercardiod microphones in fixed placement around the elliptical shape, with no numerical specification made to the amount of microphones.

While the end-user could switch electronically between microphones much as is specified in the patent, this ability to do so is not specific to the Modular Microphone Array design.

In U.S. Pat. No. 4,042,779 (Craven and Gerzon) issued August 1977 is disclosed a device, based on a set of principles for recording a multi-channel, surround soundfield in a manner termed B Format. The principles behind the Soundfield are not directly compatible with the type of recording currently necessary for the ITU R 775BS specification for the playback of 5.1 channel surround sound, though work is progressing on digital signal processing (DSP) algorithms that transform B Format recordings into the ITU R 775BS playback standard.

In professional literature (G. Theile, Das Kugelflachenmikrofon, 14 Tonnemeistertagung des VDT, Pp 277–293, 1986). Is disclosed the Schoeps Sphere stereo Microphone KFM 6 which was designed by Dr. Gunther Theile for German microphone manufacturer Schoeps GmbH. The Stereo Sphere is based on the use of a 200 mm wooden ball-shaped sphere, in which are mounted two opposing transducers.

A further version of this design, the Schoeps KFM 360, derives multichannel surround sound through the addition of two figure-of-eight transducers, externally mounted in relation to the existing two opposing transducers. The developer of this version of the Schoeps Sphere, Jerry Bruck (New York City), has stated in print that this design is unpatented and "dedicated to the public domain" for further development. This is a design that differs from the arrangement disclosed herein in four key areas. First, the shape is fixed as a sphere. Second, in addition to the two transducers as found in the original KFM 6 design, that are of fixed location within the sphere, the KFM 360 has the two additional figure-of-eight transducers placed externally, adjacent to the two internally mounted transducers and the surface of the sphere. Third, the object described depends on signal processing to be effective. Fourth, the device is limited to recording only to four channels.

In U.S. Pat. No. 4,658,932, April 1987 (Michael Billingsley) and U.S. Pat. No. 4,361,736 (Ronald Wickersham and Edward Long) is disclosed a device manufactured as the Crown PZM and SASS microphone systems which makes use of the pressure zone effect, which combines the direct sound with the first reflection from a nearby boundary to produce a coherent pickup by the microphone transducer.

In the pressure-zone approach, the linear bandwidth of the transducer is (in part) dependent upon the spacing of the transducer from the reflecting surface. This PZM approach trades off the out-of-band cancellation effects for the in-band additive effects that result from summation of direct and reflected sound reaching the transducer diaphragm. The mounting configurations for the transducers used in our device do not use the pressure zone effect. Instead, the transducers are mounted in a coplanar manner that avoids the cancellation effects of nearby surface reflections across the entire frequency-range of the transducer.

In European patent EP 0 848 572 A1 (Hitoshi Ishiwata) is disclosed a microphone unit comprising a semi-spherical structure base, a first microphone element having at least two directivities which is attached to a left end of the structure and a second microphone element having at least two directivities which is attached to a right end of the structure. The patent describes a semi spherical shape, ranging from 10 to 50 cm in diameter, with four directional microphones mounted in pairs, back-to-back on opposing sides of the sphere's surface. This arrangement results in two microphones facing forwards and two facing rearwards on the lateral plane. The resultant sound pick-up provides either a two or four channel output, dependant on the routing and processing of the signals received from the two or four microphones. The patent further describes processing of the output signal as integral to providing the desired results of a stereo (2 channel) or "natural sound" (4 channel) output from the device.

The patent describes a design that differs from the arrangement disclosed herein in three key areas. First, the shape is fixed as a sphere. Second, the transducers are fixed in one location on top of the surface of the sphere. Third, the object described depends on signal processing to be effective.

In U.S. Pat. No. 6,041,127 (Elko) issued March 2000 and assigned to Lucent Technologies is disclosed a first-order differential microphone array with a fully steerable and variable response pattern. One illustrative embodiment of the present invention comprises a microphone array consisting of 6 small pressure-sensitive omni-directional microphones flush-mounted on the surface of a ¾" diameter rigid nylon sphere. The microphones are advantageously located on the surface at points where included octahedron vertices contact the spherical surface. By selectively combining the three Cartesian orthogonal airs with scalar weightings, a general first-order differential microphone beam (or a plurality of beams) is realized which can be directed to any angle (or angles) in three-dimensional space. The microphone array may find use in surround sound recording/playback applications and in virtual reality audio applications.

Calling on an elaborate digital signal processing of the output signals of its sphere-mounted microphones, the Steerable and Variable First-order Differential Microphone Array is attempting to create a first-order, directional microphone with a steerable signal. The small sphere has six omni-directional transducers (in the illustrated design) mounted in an orthogonal relationship on the surface of the ¾" diameter sphere, such that with the application of digital signal processing to any variety of signal combinations, various directional patterns of audio reception can be derived from the output.

The patent claims that the device can be used for surround sound applications in the abstract of the invention, but this is not elaborated further in the body or claims sections of the patent. The output of a surround sound signal from this device would most likely exhibit some of the qualities as found in a B Format signal (see above, Soundfield/Gerzon) and present DSP challenges in deriving a standard ITU R 775BS, 5.1 channel surround sound output, due to the microphone positions and spacing obtained from the ¾" sphere. This is a design dependant on specialized processing to derive a surround output;

U.S. Pat. No. 4,675,906 (Sessler and West) issued June 1987 discloses a thin-walled, plexiglas cylinder of 5 cm outer diameter, hollow with two open ends serves as the mounting device for four bi-directional microphones, at 90 degree intervals on the wall of the cylinder, as seen from above. The microphones are mounted "symmetrically" to the cylinder: flush, with one lobe of the bi-directional element of each microphone facing outwards and the second lobe facing inwards. The open nature of the cylinder thus allows the reception of sound waves traversing the cylinder to be received at different intensities; the combination of the inner and outer facing lobes of each microphone creates a distinct directional reception of sound. Combined, the four microphones have a toroidal pick-up pattern about the cylinder, with a distinct bias towards frequency reception in the range of human speech. Thus, the device is designed as a single output (monaural) microphone array for use in applications such as conferencing.

Two further systems have recently been developed in Germany. The systems are both open framework mounting structures, relying on a suspension system composed of a central mounting hub and connected metal tubing that allows microphones to be suspended in space. The first system has fixed extensions from the centre; the second—currently in prototype form—accommodates adjustment. The systems are:

The SPL/Brauner Atmos 5.1 which has five booms extending from a centre point, each fixed in distance from that point. Specific Brauner brand microphones, with pressure gradient transducers facing outwards from center, are mounted on the ends of the booms. The five microphones do not make use of physical boundaries or structures beyond the typical transducer diaphragm and housing. This configuration came on the market in 1999 and is still available.

The Optimized Cardiod Triangle—OCT, which is another design by Gunther Theile (see Schoeps Sphere), the OCT has adjustable tubing that can alter, within small increments of up to approx 20 cm, the spacing of an array of individual microphones. As with the SPL/Brauner device, this design does not make use of physical boundaries or structures between all microphones beyond the typical transducer diaphragms and housings.

SUMMARY OF THE INVENTION

One object is a modular mounting system that accommodates a variable number and types of transducers (microphones), from a single microphone to multiple microphone arrays, intended for use in a variety of audio recording methods, ranging from single channel monaural, stereo and as an important aspect—surround sound recording.

According to the invention there is provided a microphone mounting system comprising:

a plurality of mounting elements each arranged to receive and support a respective microphone transducer;

a plurality of spacer elements;

the mounting elements and the spacer elements being connectable to form a body for supporting the microphone transducers in a prearranged array;

the spacer elements and the mounting elements of the system being selectable and mountable to provide different arrangements and numbers of the transducers on the body as required.

The key element is the modular nature of the resulting structure containing the microphones. A capped, circular ring is disclosed in the description hereinafter. Several variants on this existing design can also be included; particularly but not exclusively one in which the array is made up of sections, much like a grapefruit, hung on a central post and another in which the outer panels express an angular surface, that is a polygon or faceted structure as opposed to a smooth curve.

Preferably the spacer elements and mounting elements have an outer surface which can be connected together so that the outer surfaces combine to define a closed outer surface of the body.

Preferably the closed outer surface of the body is smoothly curved.

Preferably the spacer elements and mounting elements each form a panel with an outer surface and an inner surface which can be connected together so that the outer surfaces combine to define a closed outer surface of the body and the inner surfaces combine to form a hollow interior of the body.

Preferably the panels have a thickness between the inner and outer surfaces sufficient to receive the transducer therein.

Preferably the spacer elements and mounting elements include a set of elements which combine to form an outer surface which is generally barrel or cylinder shaped.

Preferably the spacer elements and mounting elements include a set of elements which provide top and bottom caps on the barrel shape.

Preferably the top and bottom caps are generally dome shaped.

Preferably there are provided different top and bottom caps having different curvatures which can be selected.

Preferably there is at least one transducer in at least one of the top and bottom cap.

Preferably the mounting elements are acoustically non-resonant, so that the interior of the body is acoustically damped.

Preferably each transducer is mounted in a resilient, acoustically dampened sleeve carried in a respective one of the mounting elements.

Preferably each transducer is mounted in the respective mounting element so that a diaphragm thereof is coplanar with an outer surface of the mounting element.

Preferably there is provided a mounting post with a support member carried on the post and surrounding a longitudinal axis of the post with the mounting elements and spacer elements carried on the support member at spaced positions therearound.

Preferably the support member comprises a disk member having a hub on the post and a peripheral portion engaging the mounting elements and spacer elements.

Preferably the disk member includes a pair of axially spaced disks.

Preferably each of the mounting elements and spacer elements includes a locking projection portion engaging the disk member.

According to a second aspect of the invention there is provided a microphone mounting system comprising:

a body for supporting a plurality of microphone transducers in a prearranged array;

wherein the body forms generally a cylindrical structure having an outer surface with a generally barrel or cylinder shape with at least some of the transducers mounted in the outer surface;

and wherein there are provided top and bottom closure caps to close the body.

The body may be solid or hollow.

The system is designed through the use of modularity to allow a nearly infinite variation in microphone spacing through selection of size and type, and/or physically positioning the transducers. Sound recordists creating high quality recordings generally would prefer as direct an unadulterated signal from the microphone to the recording device as is possible, without the intervention of signal processing. The design can accommodate digital signal processing (DSP).

DETAILED DESCRIPTION OF PREFERRED EMBODIMENTS

Figure 1:
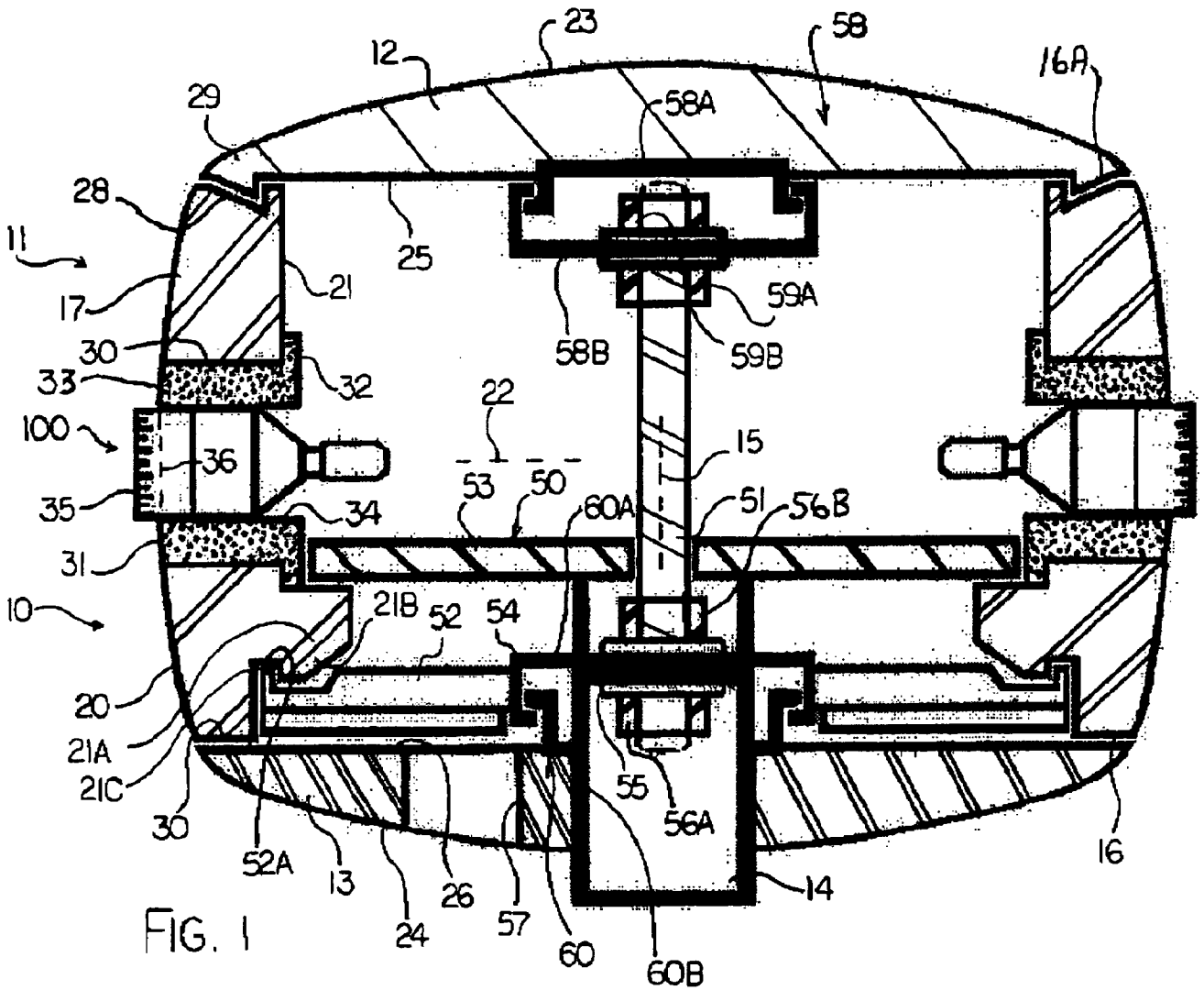
FIG. 1 is a vertical cross-sectional view through one embodiment of microphone mounting system according to the present invention.
Figure 2:
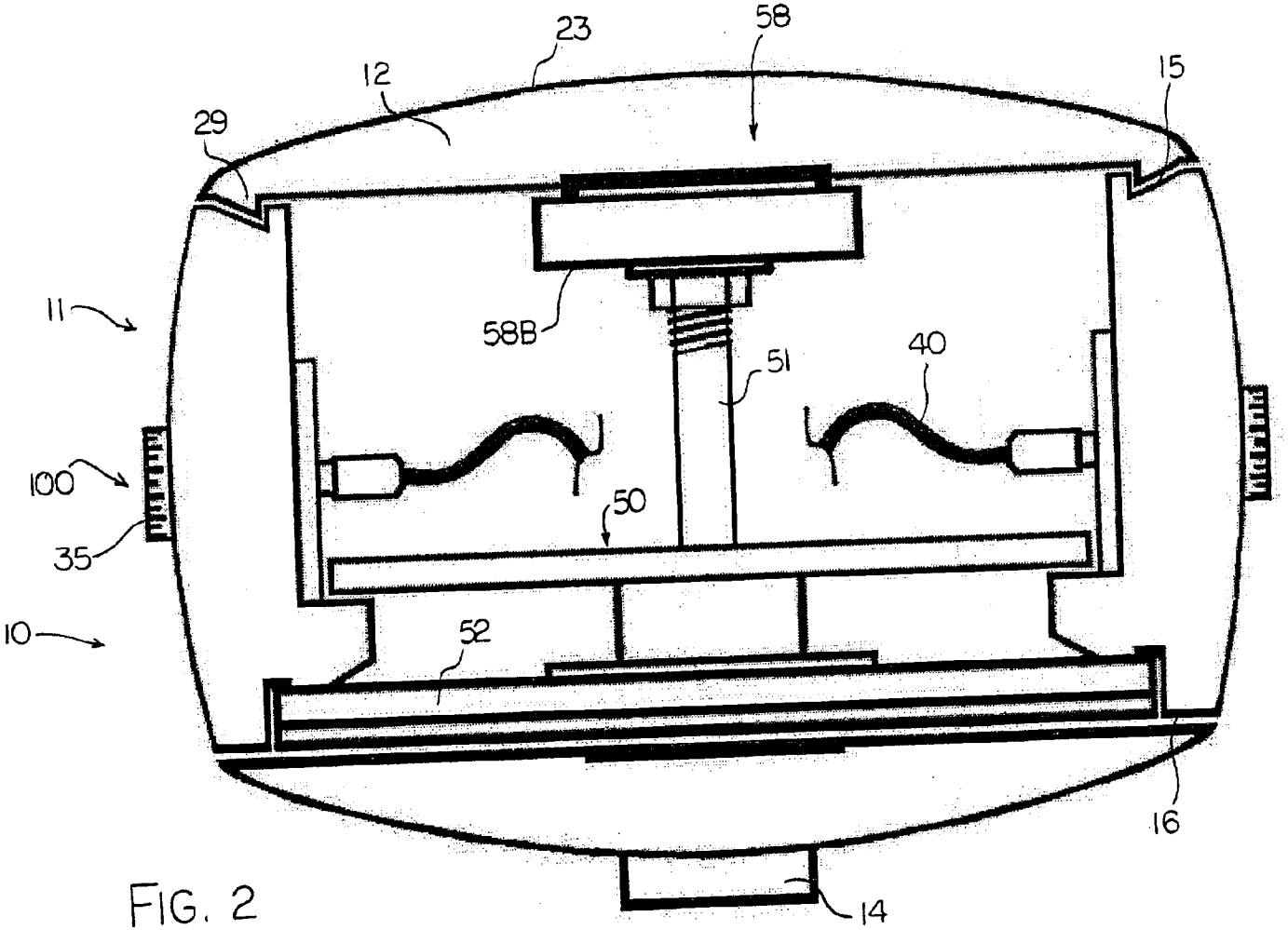
FIG. 2 is a side elevational view of the embodiment of microphone mounting system of FIG. 1 with some of the mounting elements removed.
Figure 3:
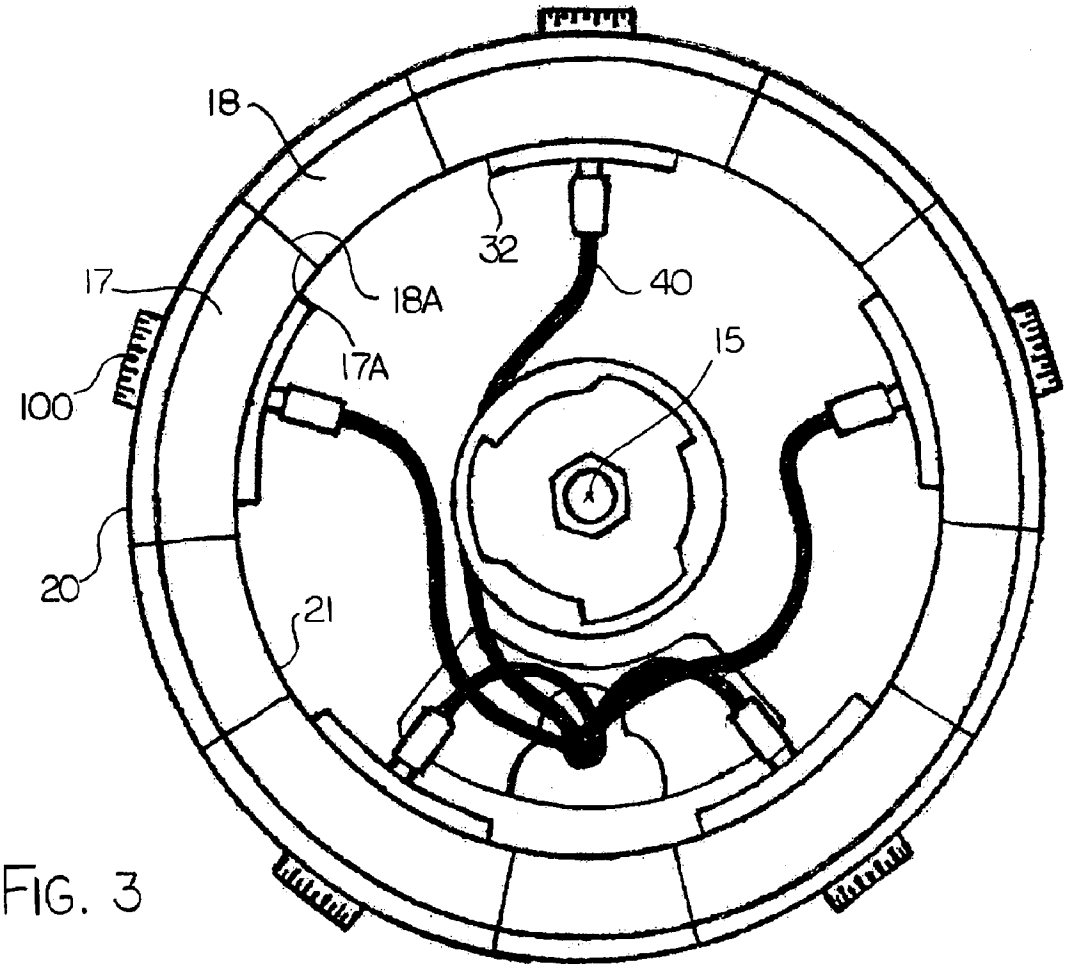
FIG. 3 is a top plan view of the embodiment of microphone mounting system of FIG. 1 with the top cap removed.

In the figures is shown a body 10 for mounting a plurality of transducers 100 in an array. The body 10 includes a main body portion 11, a top cap 12 and a bottom cap 13 all mounted an a post 14. The post 14 defines generally longitudinal axis 15 and the main body portion 11 is generally cylindrical in shape surrounding the axis 15 and extending from an upper face 16A to a lower face 16. The main body portion 11 is formed from a plurality of angularty separated segments defining mountings elements 17 end spacer elements 18. Each of these elements extends around a part of the cylindrical shape defining the main body portion 11 so that together the segment shaped elements sit side-by-side and form a complete solid cylindrical body. The body shape has a smoothly curved outside surface to form a generally barrel shaped outer surface. The elements also have an inside surface lying generally on a cylinder surrounding the axis 15. The segment shaped elements thus includes side surfaces 17A, 18A which lie in an axial plane and thus simply butt side-to-side forming a contiguous outer surface 20 and a contiguous inner surface 21. The outer surface 20 is generally barrel shaped extending from the upper edge 16A to the lower edge 16 so that it increases in diameter to a center line generally indicated at 22 on which the microphones 100 are located. The increase in diameter in the embodiment shown is relatively small so that the radius of curvature is much greater than that of a sphere centered on the axis 15. Also the end cape 12 and 13 are relatively flat. Thus the end caps 12 and 13 have a domed outer surface 23, 24 which has a radius of curvature much greater than a sphere located on the center line 22. The top cap 12 has an inside surface 25 which is flat and similarly the bottom cap 13 has an inside surface 26 which is also flat with both lying in a radial plane of the axis 15.

Each of the mounting elements 17 and each of the spacer elements 18 is formed as a solid body from a suitable solid material which may be plastics, wood or the like. The upper edge of each of the elements is formed with a notch 28 which co-operates with a projection 29 surrounding the end cap 12 so as to act to locate the elements at there upper edges and prevent outward movement of the elements relative to the outer surface of the end cap 12.

A bottom surface of each of the elements as indicated at 30 is substantially flat and fits on top of the top surface 26 of the bottom cap.

The solid body forming the mounting elements 17 is drilled or formed to provide a bore 30 with an axis lying on the center line 22 and extending radially outwardly relative to the axis 15. Within the bore 30 is mounted a sleeve 31 of a resilient material such as neoprene with an end cap 32 of the sleeve butting against the inside surface 21 and the sleeve extending through the thickness of the element 17 to an outside surface 33 coincident with the outside surface 20 of the body.

Within the resilient sleeve is mounted the transducer 100 which provides a generally cylindrical body received as a friction fit within the inside surface 34 of the sleeve. An end cap 35 of the microphone stands slightly proud of the outside surface of the body. The diaphragm 36 of the transducer is arranged so that it lies substantially on the outside surface.

Commercially available transducers are readily available for insertion into the sleeve. Different size sleeves can be used to accommodate different sizes of commercially available transducer.

The transducers are connected via leads 40 to a suitable electrical connection contained which may be within the hollow interior but in most cases the cabling carries through to the outside of the device where connection is normally done outside of the device. Some microphone designs have the connecting junction on the body of the microphone, which would hence be internal to, or "within", the device.

The post 14 supports the body so that it can be mounted with the post vertical and the center line 22 thus horizontal. However other orientations are possible and the bodies supported on the post so that it can be moved with the post as required.

The poet 14 carries a mounting disc member generally indicated at 50 which is attached onto a threaded rod 51 carried on the upper end of the post. The disc member 50 includes a lower disc 52 and an upper disc 53. The lower disc 52 surrounds a cap portion 54 of the post 14. The upper disc 53 surrounds the shaft 51. The threaded rod 51 is carried on a mounting plate 55 at the top of the post and is held in place in that mounting plate 55 by a pair of nuts 56A and 56B threaded onto a threaded lower section of the shaft 51 and clamping between them the plate 55. An opening 57 is provided in the bottom cap 13 for exit of the electrical wiring for communication of the signals from the transducers.

At the top of the shaft 51 is provided an attachment for the top cap 12, generally shown at 58. The attachment can be in the form of a simple threaded receptacle which is embedded in the underside of the cap and threads onto the upper threaded portion of the shaft 51. However in the embodiment shown, the attachment 58 comprises a bayonet fitting with a male portion 58A attached to the underside of the cap and the female portion 58B attached to the shaft 51 by nuts 59A and 59B. Thus the top cap can be attached in place simply by inserting the male fitting 58A into the female 58B and rotating through a predetermined angle to lock the bayonet fitting in place. This acts to pull the edges of the top cap down onto the notch 28 and to hold the structure integral.

A similar bayonet fitting is provided at 60 by which the bottom cap 13 can be slide up over the post and be attached onto the upper end of the post including the female fitting 60A and the male fitting 60B on the bottom cap.

The discs 52 and 53 act to locate the bottom end of the mounting and spacer panels. Thus the upper surface of the bottom disc 52 includes a groove 52A adjacent its outer edge and this co-operates with a projecting portion 21A of the rear surface of each of the panels. The projecting portion has a height substantially equal to the spacing between the discs 52 and 53 so that a top surface of the projecting portion 21A engages the under surface of the disc 53. In addition a downward projection 21B on the underside of the projection 21A engages into the recess 52A and provides a shoulder 21C which engages against the side edge of the recess 52A. Thus the projection 21A can be snapped into place by slight distortion of the discs and is held in place by the engagement of the projecting portion 21B and the engagement of the top surface of the projection 21A with the underside of the top disc 53.

Thus the structure is integrally and effectively supported upon the disc member 50 carried on the post. The top and bottom caps can be readily removed by simply twisting and pulling away from the main barrel shaped body. The mounting elements and space elements can be snapped out of engagement with the supporting disc member 50 and rearranged at different angular spacing or removed and replaced. Thus the number of transducers can be readily changed by removing the mounting elements and replacing them with spacer elements of the same or different angular dimensions. The spacers can also slide horizontally about the radius of the disc member 50, as they are being rearranged.

The above described design facilitates accurate and repeatable configurations suited to a variety of studio and field recording situations and standards. The design supports a wide variety of transducer types (microphones) and is independent of any specific manufacturer's model or type. The novel overall shape, with attendant capability to be modified, is a further attribute. The lightweight, compact design ensures portability and ease of deployment in recording situations.

The device described above provides a unique design, one that is capable of utilisation for a variety of recording situations, ranging from the reception of a single, monaural audio output to that of a multi-channel audio—surround sound—recording. The device described above facilitates the placement of any number of transducers (microphones) in a single mounting device, the amount determined by the end-user's recording requirements. The location of each transducer, in relation to the overall arrangement of other transducers, becomes determined strictly by the needs of the recording engineer/sound recordist.

The modular aspect of this design described above, which is flexible and variable in nature, is a unique property. Historically, many methods and designs for traditional two-channel stereophony have had transducers fixed in placement, with little or no flexibility towards the addition or subtraction of transducer elements. In such designs for stereo-based arrays, the fixed transducer elements of each design provided a specific quality to the results. The audio engineer/sound recordist knew what to expect, including inherent limitations, from each design. Contemporary designs for multi-channel, surround sound recording have, to date, followed a similar pattern in design, with each existing design suggesting a single mode or method of sound reception in the fixed arrangement of the transducers.

The arrangement described above takes a new approach in recognition of the variety of context-dependant recording needs and the many proposed standards for multichannel surround recording. The modular design is a first for microphone arrays. By accommodating many potential patterns for the layout of the transducer array and the number of channels to be recorded, the arrangement disclosed herein allows a degree of flexibility that is not available in other designs.

The overall shape and size of the arrangement described above has been designed to allow an acoustically integrated, multi-channel audio reception of a soundfield, on a lateral plane for the full 360 degrees around the device. Further, the design described above enables the reception of the soundfield above and below the lateral plane: this can be accomplished through augmenting the lateral transducer array with the placement of transducers above and below the lateral plane, that is on the upper or lower sections or domes of the device, if so required by the recording session.

An important feature of the cylinder shape of the body is that the ends of the ring are closed to the exterior so that the resulting interior space is acoustically neutralised to avoid internal sound reflection and/or resonance through the incorporation of acoustical dampening materials. The current design features the vertical face of the ring shape canted very slightly inwards top and bottom from the centre line.

The device does not need to be manufactured in a modular manner allowing selection of pieces for different arrangements, but if so, the modularity of the device allows further modification of this face, ranging from completely flat to hemispherical, on the vertical axis.

The capped top and bottom of the ring shape can accommodate a variety of shapes attached to the horizontal plane formed at both ends of the cylinder. Such shapes range from a completely flat plane to that of a hemisphere. Further, the caps seamlessly integrate with the band of the cylinder. However there could be an abrupt transition or reflect the current design, which shows a gentle curve to the vertical as the caps approach the area of integration with the top and bottom of the ring's cylinder. The degree to which the upper and lower caps vary from flat to hemispherical is determined by the recording needs. The design makes room for variance, due to the modular nature of the upper and lower caps.

The key aspect of modularity in the design is found in the make-up of the set of modular elements, each capable of presenting either a smooth blank face or a smooth face with an integrated transducer; each modular element is nested in the device by the disk mounting and accompanied by modules on either side.

Through testing it has been determined that, when placed in the modules, the diaphragm of the transducer should be presented to the exterior on the same plane as the outer face of the device. This is accomplished through the use of the sleeve that holds the transducer, fitting directly into a hole in the mounting elements. Each transducer is nested in a sleeve of a suitable material, such as neoprene, that has been form-fitted for the specific transducer model and precision moulded to ensure that the fit is consistent throughout the design. If a variance would be desired from the prescribed transducer placement, which would result in a different relationship between the transducer diaphragm and the outer surface of the device, the sleeve design could easily accommodate this variance through a simple modification of the sleeve design.

A further method that would utilise this design is found in the creation of array patterns through the use of miniature transducers, which are commonly called lavaliere microphones, where the shape of the device serves as the foundation upon which to mount the transducers. External yokes can be provided to hold the bodies of the transducers in place, the yoke being designed to position the diaphragm of the transducer in the same plane as the outer surface of the shape to avoid acoustical cancellation from surface reflections. This type of relationship to the surface of the device is important to maintaining the linear frequency response of the microphone. As with the other embodiments of this design, this version can accommodate a variety of microphone brands. A further advantage of this embodiment of the device is that, as a solid lateral ring, the need for modular segments would be eliminated, making this version of the array device less costly in manufacture.

The lateral diameter of the current design of this device has been derived from contemporary research into the "average" human head diameter of 16 cm, as measured laterally on the same plane as the ears. The design principles behind the shape of the device make the 16 cm diameter an optimal physical dimension; however, other embodiments of this design may exhibit a variance smaller or larger than the human lateral diameter. As an example of why there might be a variance from the head-related predetermined shape, one needs only consider the continuous improvement of digital signal processing, which could enable a smaller physical device diameter, the signals from which would recreate an optimal surround reproduction through the application of high-order digital signal processing. With any changes to the lateral diameter of the device, compatible changes in size may be made to all other components.

Various aspects of the arrangement as described herein can provide one or more of the following advantages:

Unique design.

Simple to set up and operate.

Light in weight and compact, robust construction.

Employs a modular concept to facilitate variable placement of transducers.

Versatility in accommodating many surround recording patterns.

Captures lateral and median plane audio signals.

Thoughtful attention to shape of device ensures high quality, repeatable results.

The device facilitates the independent selection of transducers that are currently available and accommodates future transducer designs.

A Main Microphone Surround Array that meets the needs of the audio profession.

The arrangement disclosed herein provides audio recording engineers/location sound recordists with the ability to record a full 360 degree lateral plane soundfield with a single device. This is a unique design, modular in nature, lightweight, compact and one that is simple to set up. The lateral diameter of the device is derived from contemporary research that defines the ideal, "average" human head diameter, as measured laterally at the level of the ears.

When assembled, the device presents a smooth surface with a prominent shape that provides an optimal reception of sound for surround sound recording. The spacing of the transducers on a lateral plane, arranged in a circular pattern around a central hub, balances the direct and incident sounds from the sound source. Smoothly modelling the degree of shadowing of each sound source in relationship to the sound's location results in strong on-axis reception of directional cues for higher frequencies, while positively effecting the off-axis reception of other high frequency sources due to the gentle attenuation provided by the smoothly graduated shape. The design places the plane of the transducer diaphragm in a planar relation to the surface of the device; this proximity minimizes cancellation effects from reflections off the surface surrounding the transducer, creating a co-planar relationship between the transducer and the outer surface of the Modular Microphone Array.

The wiring for the transducers enters the bottom of the device adjacent the central mount. Once inside the body of the device, the individual connecting cables radiate outwards to each appropriate transducer. The individual transducer is fit into a module via an enveloping sleeve that can be slid directly into the module, designed to ensure that the diaphragm of the transducer is on the same level and plane as the outer face of the device. In most cases, the protective grill covering the transducer's diaphragm stands proud of the outer surface with this method of mounting.

The arrangement disclosed herein is well suited to professional applications in the set-up portion of the recording process. During set-up this would include 1/ ease of initial installation, 2/ predictable and repeatable transducer (microphone) orientation during preparation for recording, 3/ ability to make positional changes of the entire mic array during recording rehearsals and 4/ ease in disassembly and storage of the array at the conclusion of the session.

The design facilitates a flexible placement of the transducers in a lateral, circular pattern, enabling the sound recordist to recreate the surround soundfield in a variety of configurations. The device can also serve to accommodate a single or several transducers, if monaural or stereo recording techniques are desired.

A key quality of an optional arrangement disclosed herein is the ability to configure the device to a number of professional recording specifications, for music (mono to multi-channel), television/cinema, sound effects, theatre sound and audio for computer games. These include the standard 5.1 surround specification ITU-R 775BS, Dolby Cinema 6.1, SDDS, Holman 10.2, IMAX standard and any equidistant, symmetrical or asymmetrical transducer placement that is suited for ambient audio reception in surround. Through this accommodation of many different recording standards in multi-channel audio, the embodiment described above also represents an elevated level of versatility to the end-user, who will not have to purchase separate devices to capture each of the many standards currently demanded of surround recording. The ability of the device to create asymmetrical arrangements of the transducer arrays, rather than simply adhering to predetermined patterns, is very important in allowing variations to suit field conditions as determined by the sound recordist.

An additional optional feature of the embodiment described above is the ability to capture sound signals above and below the lateral plane, if so desired by the sound recordist, through transducer placement in the upper and lower caps. Future iterations of surround sound playback presentation, including Holman 10.2, specify overhead playback positions for speaker arrangement in surround audio presentation. The arrangement disclosed herein is designed to accommodate such developments.

In operation, the device is light enough to be used on film sets, where it might be mounted on a hand-held boom pole, the weight factor being critical in this application, for on-set pick-up of actor dialogue and interactions, walk-bys/drive-bys, ambience sound such as crowd noises, forests, street scenes; all of which could be mixed with on- or off-camera dialogue recordings in post production. In music recordings, the compact size and ease of cabling allows the device to be suspended or flown from ceilings in concert halls or mounted on a single stand to record musical ensembles. In these and other recording scenarios, the size and single mounting point of the device ensures that it can be moved and placed with ease in the recording environment, until the recording engineer is satisfied with the microphone location. Such placement is critical to fidelity, localization, ratio of direct-to-reverberant sound balance and immersion in music surround recording techniques, where subtle changes in microphone placement in relation to the performers and performance space can have a major impact on the quality of these outcomes.

The arrangement disclosed herein has been designed to recreate an acoustic event's soundfield with a high degree of accuracy. This accuracy includes the ability to locate the point of origin of specific sounds, termed localization, with a high degree of resolution and the capability to recreate the overall soundfield in a smooth, 360 degree presentation that surrounds the listener, termed envelopment, without a noticeable loss of reception in any given direction.

Studies concerning the human reception of a soundfield have determined that the shadowing effect of the human head has no significant effect at lower frequencies, where an even distribution of audio wave fronts is critical for proper reception of those frequencies. Lower frequencies tend to wrap themselves around objects, with little detrimental effect to the quality of these frequencies, if such a transition is gradual. The shadowing effect of the head, however, is necessary at higher frequencies, where the reception of directional cues that aid in the location of sound sources is critical. These factors have been taken into consideration in the design of the embodiment described above.

Recordings made with the arrangement disclosed herein exhibit a generous area of envelopment in the playback presentation, commonly referred to as the sweet spot in surround sound discussions, negating the need to use the word spot. Providing such a wide area of envelopment in playback of recordings made with this device is advantageous to soundtracks in cinema presentations, audio for theatrical performances and other presentation applications of surround audio for large audiences. In more intimate environments, such as home theatre and computer gaming, recordings created with the arrangement disclosed herein result in a vivid, convincing reproduction of the original soundfield, for listeners located in the middle of the soundfield or those offset from the centre.

The optional modular aspect of the design of the embodiment described above takes advantage of contemporary microphone design, which has resulted in compact housings for individual, high quality condenser-type transducers (microphones). The design supports a wide variety of transducer types and is independent of any specific manufacturer's model or type. The embodiment described above has been developed through the use of the compact transducers, such as the Danish Pro Audio 4050 series of transducers. The embodiment described above will be capable of accepting other compact transducer designs, such as the Schoeps CCM series of condenser microphones. An even larger range of compact, inexpensive lavaliere-style microphones, made by a host of international manufacturers, can also be accommodated by this design.

The embodiment described above is manufactured from suitable materials known in the art which provide strength and extremely light weight, acoustical dampening properties, robust wear characteristics and ease of machining and/or moulding in manufacture.

Generally, the embodiment described above consists of a central space frame or structure that mounts to microphone stands, boom poles and rigging hardware. The use of vibration isolation material, commonly known as a shock mount, may be integrated between the mounting hardware and the central space frame of the device. Shock mounts are a necessity in providing isolation from external vibration and movement, which can directly interfere with the microphone diaphragm's ability to pick-up much more subtle sonic vibrations. The internal space of the device not occupied by hardware is fitted with non resonant materials, to dampen any internal audio reflections or resonance.

The central frame can be made from a combination of materials: a lightweight metal alloy and plastic resin. Integrated into this central structure are the lower, middle and upper (bottom, ring and top) modules.

The wiring for the transducers enters the bottom of the device adjacent the central mount. Once inside the body of the device, the individual leads radiate outwards to each appropriate transducer. The transducers are fitted into each module via an enveloping sleeve, made of a semi-rigid material as neoprene that can be placed directly into the module, designed to ensure that the diaphragm of the transducer is on the same level and plane as the outer face of the device. In most cases, the protective grill covering the transducer's diaphragm stands proud of the outer surface with this method of mounting.

The embodiment described above can be used for electronic conferencing including multi-channel audio reception and playback, as it could be set central to a boardroom table. People at the front, centre or rear of the room and on the left or right side of the room would be properly oriented to their video picture on the receiving end's surround sound system, providing a concurrent visual and aural position of each person.

The device may be large enough to present problems of concealment in some applications. In this case, the surface of the embodiment described above could be of a colour or shade of gray that minimizes visual impact.

The application of digital signal processing could also be used with the current optimal 15 cm size to emulate larger virtual spacings of transducers; again, the existing device would be able to simulate this increased radius of transducer spacing through DSP treatment of the transducer signal output(s).

The embodiment described above differs from the Holophone prior art defined above in a number of key areas. First, the transducers in the are capable of being arranged in a number of patterns, unlike the fixed pattern described in the Holophone. Second, unlike the Holophone, the output is not dependent upon signal processing to provide the desired results of an immersive, surround sound playback presentation. Third, the embodiment not only utilizes the outer shape of the device to arrange the microphones, but also to tailor the sound reception, an attribute not recognized in the Holophone disclosure. Additionally, the coplanar relationship of the microphone diaphragms to the surface of the object is not recognized in the Holophone disclosure; in fact, the Holophone patent illustrates the diaphragms of the hypercardiod capsules placed several centimetres distant from the surface, essentially rendering this relationship mute.

What is claimed is:

1. A modular microphone mounting system comprising:

a plurality of mounting elements each arranged to receive and support a respective microphone transducer;

a plurality of spacer elements;

the mounting elements and the spacer elements being connectable to form a body for supporting the microphone transducers in a prearranged array;

the spacer elements and the mounting elements of the system being selectable and mountable to provide different arrangements and numbers of the transducers on the body as required.

2. The system according to claim 1 wherein the spacer elements and mounting elements have an outer surface which can be connected together so that the outer surfaces combine to define a closed outer surface of the body.

3. The system according to claim 2 wherein the closed outer surface of the body is smoothly curved.

4. The system according to claim 1 wherein the spacer elements and mounting elements each form a panel with an outer surface and an inner surface which can be connected together so that the outer surfaces combine to define a closed outer surface of the body and the inner surfaces combine to form a hollow interior of the body.

5. The system according to claim 4 wherein the panels have a thickness between the inner and outer surfaces sufficient to receive the transducer therein.

6. The system according to claim 1 wherein the spacer elements and mounting elements include a set of elements which combine to form an outer surface which is generally barrel shaped.

7. The system according to claim 6 wherein the spacer elements and mounting elements include a set of elements which provide top and bottom caps on the barrel shape.

8. The system according to claim 7 wherein the top and bottom caps are generally dome shaped.

9. The system according to claim 7 wherein there are provided different top and bottom caps having different curvatures which can be selected.

10. The system according to claim 7 wherein there is at least one transducer in at leant one of the top and bottom cap.

11. The system according to claim 1 wherein the mounting elements are acoustically non-resonant, so that the interior of the body is acoustically damped.

12. The system according to claim 1 wherein each transducer is mounted in a resillent sleeve curried in a respective one of the mounting elements.

13. The system according to claim 1 wherein each transducer is mounted in the respective mounting element so that a diaphragm of said transducer is coplanar with the outer surface of the mounting element.

14. The system according to claim 1 wherein there is provided a mounting post with a support member carried on the post and surrounding a longitudinal axis of the post with the mounting elements and spacer elements carried on the support member at spaced positions therearound.

15. The system according to claim 14 wherein the support member comprises a disk member having a hub on the pout and a peripheral portion engaging the mounting elements end spacer elements.

16. The system according to claim 15 wherein disk member includes a pair of axially spaced disks.

17. The system according to claim 15 wherein each of the mounting elements and spacer elements includes a locking projection portion engaging the disk member.

18. A microphone mounting system comprising:

a hollow body for supporting a plurality of microphone transducers in a prearranged array;

wherein the body forms generally a cylindrical structure having an outer surface with a generally barrel shape with at least some of the transducers mounted in the outer surface;

and wherein there are provided top and bottom closure caps to close the body.

19. The system according to claim 18 wherein the closed outer surface of the body is smoothly curved.

20. The system according to claim 18 wherein the body has a generally cylindrical hollow interior.

21. The system according to claim 18 wherein the top and bottom caps are generally dome shaped.

22. The system according to claim 18 wherein each transducer 1i mounted in a resilient sleeve carried in the body.

23. The system according to claim 18 wherein each transducer is mounted in the body so that a diaphragm thereof is coplanar with an outer surface of the body.

* * * * *